United States Patent [19]

Nichols, Jr.

[11] Patent Number: 4,622,041

[45] Date of Patent: Nov. 11, 1986

[54] TEXTILE DYEING PROCESS

[75] Inventor: David B. Nichols, Jr., Dalton, Ga.

[73] Assignee: RCA Corporation, Princeton, N.J.

[21] Appl. No.: 916,893

[22] Filed: Jun. 19, 1978

[51] Int. Cl.[4] ..... D06P 5/00

[52] U.S. Cl. ..... 8/478; 8/484; 8/485; 8/561; 8/680; 8/924; 8/929

[58] Field of Search ..... 8/1 XB, 14, 15, 25, 8/478, 484, 485

[56] References Cited

U.S. PATENT DOCUMENTS

| | | | |
|---|---|---|---|
| 545,420 | 8/1895 | Bamford | 8/1 XB |
| 617,772 | 1/1800 | Rettig | 8/14 |
| 790,718 | 5/1905 | Bucher | 8/14 |
| 1,210,279 | 12/1916 | Diener | 8/14 |
| 1,579,872 | 4/1926 | Lecjaky | 8/14 |
| 1,754,287 | 4/1930 | Shoemaker | 8/14 |
| 2,002,848 | 5/1935 | Cohen | 91/18 |
| 2,090,890 | 8/1937 | Howard et al. | 8/5 |
| 2,313,726 | 3/1943 | Atwell | 260/20 |
| 2,321,974 | 6/1943 | Bird | 8/14 |
| 2,359,776 | 10/1944 | Milne et al. | 8/65 |
| 3,220,793 | 11/1965 | Parsons | 8/14 |
| 3,414,368 | 12/1968 | Kitamura et al. | 8/64 |
| 3,468,694 | 9/1969 | Moritz et al. | 8/15 |
| 3,669,611 | 6/1972 | Shimauchi et al. | 8/14 |
| 3,756,770 | 9/1973 | Kahayushi et al. | 8/14 |
| 3,945,791 | 2/1976 | Bohrn | 8/14 |
| 3,963,428 | 6/1976 | Stark | 8/1 XB |
| 4,000,964 | 1/1977 | Newton | 8/14 |
| 4,010,709 | 3/1977 | Sayman et al. | 8/1 XB |
| 4,189,302 | 2/1980 | Toland | 8/14 |

FOREIGN PATENT DOCUMENTS

| | | | |
|---|---|---|---|
| 763022 | 7/1971 | Belgium | 8/1 XB |
| 2147972 | 3/1973 | Fed. Rep. of Germany | 8/14 |
| 2148871 | 5/1973 | Fed. Rep. of Germany | 8/62 |
| 4540716 | 12/1977 | Japan | 8/14 |
| 490532 | 8/1938 | United Kingdom | 8/65 |
| 740291 | 11/1955 | United Kingdom | 8/65 |
| 1243903 | 8/1971 | United Kingdom | 8/14 |
| 1363129 | 8/1974 | United Kingdom | 8/14 |

OTHER PUBLICATIONS

Dawson, Jour. of Soc. of Dyers & Colorists vol. 90, pp. 235–238, Jul. 1974.

Wigfall, S. Textile Colorist Apr., 1944, pp. 170–173.

Amer. Dyestuff Reporter (ADR) Jul. 23, 1951, p. 478.

ADR Jun. 1971, pp. 25–31, Leifeld, G.

German Publ., *Kusters*, 1973.

Hall, A., The Standard Handbook of Textiles, pp. 288–289.

*Primary Examiner*—A. Lionel Clingman

*Attorney, Agent, or Firm*—Joseph S. Tripoli; George E. Haas; William Squire

[57] ABSTRACT

A continuous process for dyeing a carpet in which spaced regions of the tufted side of a pre-wetted carpet are first compressed in a desired pattern. The tufted surface is then covered with a viscous water-soluble gum, and drops of a less viscous gum are then applied to the viscous gum-wetted tufts. Next, drops of a viscous dye are applied to the tufted surfaces and then a less viscous dye is applied over the entire tufted surface of the carpet.

8 Claims, 10 Drawing Figures

30
34
36
38
12

92"
98
92'
94'
96

90
88
72'
86
WHITE
COLOR 1
COLOR 2
COLOR 2a

72'
93
95
86
90
88

94"
94'
98
96

TEXTILE DYEING PROCESS

The present invention relates to a continuous process for dyeing textiles which is particularly suitable for carpeting.

Of interest are U.S. patent application Ser. No. 757,371, filed June 22, 1985, entitled "Textile Dyeing Process for Multicolor Nylon Carpet," by David Banks Nichols, Jr. (allowed), which is a continuation of U.S. patent application Ser. No. 916,900, filed June 19, 1978, entitled "Textile Dyeing Process" (abandoned); U.S. patent application Ser. No. 916,903, filed June 19, 1978, entitled "Textile Dyeing Process," by David Banks Nichols, Jr.; U.S. patent application Ser. No. 916,901, filed June 19, 1978, entitled "Textile Dyeing Process," by David Banks Nichols, Jr.; and U.S. patent application Ser. No. 916,889, filed June 19, 1978, entitled "Textile Dyeing Process," by David Banks Nichols, Jr., all of the above being assigned to the assignee of the present invention.

TAK dyeing, which is a relatively recent development in the carpet industry, is a continuous dyeing process in which dye is deposited, in drops, on the tufted side of the carpet. A wide variety of dye colors may be employed and different random color patterns obtained. Typical apparatuses which may be used for applying the dyes in drops are disclosed for example, in U.S. Pat. Nos. 3,683,649; 3,800,568; 3,726,640; 3,731,503; 3,964,860 and 4,010,709.

The ever changing tastes of the public places a continuous demand on the carpet industry for new styles which are both pleasing and attractive. In my copending application Ser. No. 661,396, filed Feb. 25, 1976, now abandoned, I describe a method and apparatus, now in wide use, for producing one group of such styles. In this method, a layer of liquid, such as a water soluble gum, is applied to the tufted surfaces of the carpeting and then drops of dye(s) are applied to the gum wetted tufts. The dye or dyes spread, blend, attenuate and provide, in the finished product, randomly varying patterns with gentle shading effects, which are pleasing to the eye.

I describe a second dyeing technique in my copending application Ser. No. 851,418, filed Nov. 14, 1977, now U.S. Pat. No. 4,146,362. Here, a relatively viscous first dye is deposited, for example in drops onto spaced regions of a textile and a less viscous second dye is then deposited onto regions of the textile which include the spaced regions. The first dye colors the regions of the textile it reaches in the first dye color and masks these regions from the second dye. The second dye colors the regions of the textile it reach in the second dye color and does not substantially affect the regions of the carpet masked by the first dye. This process provides additional new and pleasing coloring effects; however, the market continually demands other pleasing styles.

In a process embodying the invention for dyeing a textile, a relatively viscous liquid, such as water soluble gum, is deposited over a first region of the material and a second liquid which also may be a water soluble gum and which has a different viscosity than the first liquid, is deposited over the wetted first region. A first dye is then deposited on third spaced regions of the material which may include the first region and a second dye substantially less viscous than either the first dye or the first and second liquids is applied to regions which include the first, second and third regions.

Figure 1:
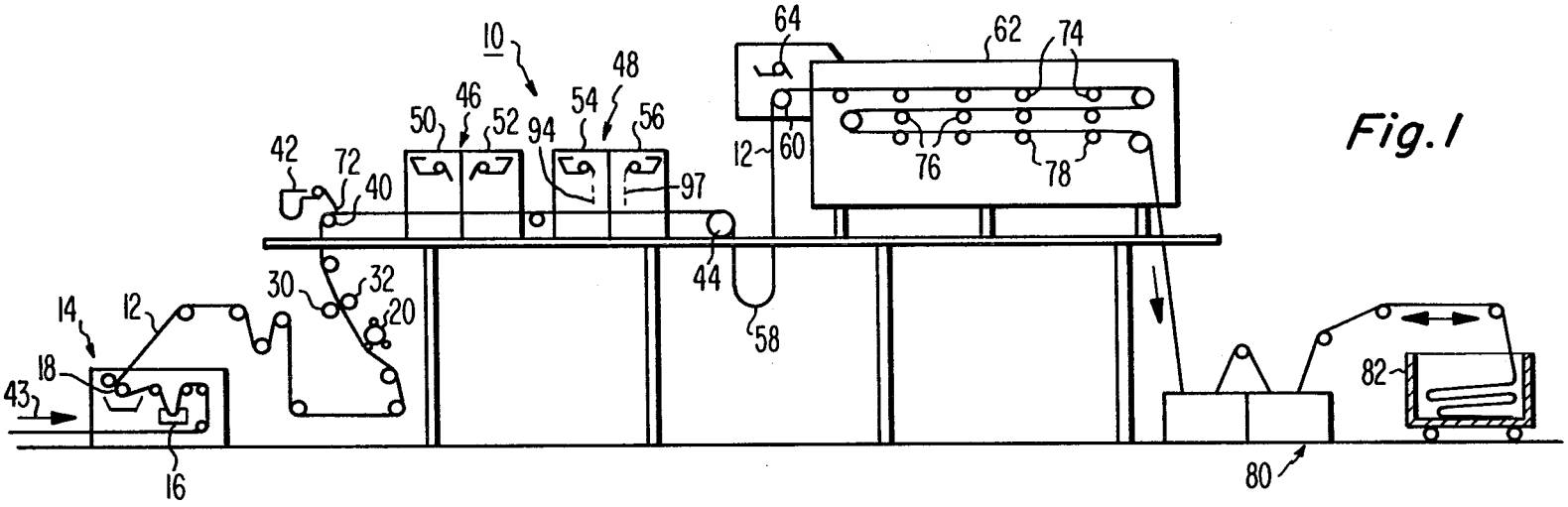
FIG. 1 is a schematic side elevational of a carpet dyeing apparatus used to practice the process embodying the present invention.

The apparatus shown in FIG. 1, while particularly suitable for dyeing carpeting, may also be used for woven or flocked textiles. Carpeting will be used as an example herein. The carpeting 12 is fed from a supply roll (not shown) through a pad machine 14. The latter includes a reservoir 16 containing a pre-wet solution through which the carpet passes. The carpet is then conveyed through two squeeze rollers 18 which remove sufficient pre-wet solution from the carpet tufts to provide a desired percent "liquid pick-up" in the carpet. "Pick-up" is a measure of the weight of the liquid in a given area of the carpet and in particular is the ratio of the weight of the liquid in the given area of the carpet to the dry weight of the same area of the carpet multiplied by 100. In one particular form of the invention, the pre-wet solution in the reservoir is at room temperature and contains gum having a mixed viscosity of about 50 centipoise (CPS) and a pH of about 7. This viscosity may have a value in the range of 50 CPS to 200 CPS. The gum helps to maintain the tufts in a prone position after they are subsequently compressed, as discussed later. This pH may be in the range of 0 to 7.

Figure 2:
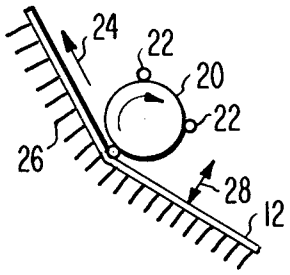

The carpeting 12 is then fed by a plurality of guide rollers past a beater 20 shown in greater detail in FIG. 2. The beater comprises a central roller and a plurality of elongated pipes 22 extending in the axial direction of the roller and secured to its surface.

In operation, the beater 20 is rotated at high speed so that the pipes 22 strike the backing of the carpet as the carpet is moved in the direction 24. This action causes the carpeting to vibrate in the directions 28 and the vibration causes the wetted tufts 26 to "stand up" (to extend generally at right angles from the backing).

The carpeting 12 then passes between a print roller 30 and a back-up roller 32, as shown in FIG. 1. The roller 30 comprises a cylinder with a plurality of printing pads, which may be made of hard rubber, secured to the surface of the cylinder in a desired pattern. One such pad is shown at 34 in FIG. 10. (In an alternate arrangement, the print roller may comprise a cylinder with cut outs in the surface thereof). The beater 20, the print roller 30 and the pressure roller 32 extend across the entire breadth of the carpeting. As the carpeting 12 passes between rollers 30 and 32, the pads 34 compress the tufts at regions such as 36, **36*a*, 36*b* and so on shown in FIGS. 4 and 10, causing these tufts to fold over, that is, to assume a prone orientation. The remaining tufts not in contact with the raised pads 34 on roller 30 remain upright. Due to the gum in the pre-wet solution, most of the compressed tufts tend to remain in their prone orientation until after they pass drop applicators 54 and 56 in machine 48. However, some of the tufts, such as tufts 38 of FIG. 10**, may tend to become upright before they reach the drop applicators and this is acceptable.

The carpet web then advances upwardly and around roller 40, FIG. 1 and past a viscous liquid applicator 42. An applicator of this type is described in detail in my copending application Ser. No. 661,396, filed Feb. 25, 1976. In the present process the applicator 42 applies a sheet of colorless viscous gum to the tufted face of the carpet over the entire width of the carpet web. This gum is a water base vegetable gum solution which is chemically inert with respect to later applied dyes. Chemically inert implies that there is no chemical reaction between the gum and the dye. The carpet is oriented horizontally at this point. The web of carpeting is then pulled horizontally over guide rollers by drive roller 44 through machines 46 and 48.

Machine 46 comprises two identical, separate drop dispensing applicators 50 and 52 which are opposite and facing each other. Machine 46 also comprises two separate and independent identical drop dispensing applicators 54 and 56. Machine 48 has the capability of dispensing drops (or streams) of a liquid in a zig-zag pattern over spaced areas 39 *a–e* and 41 *a–e*, FIG. 4 and is sometimes referred to as a multi-TAK machine. For purposes of the following discussion "drops" will be referred to by way of example but it is to be understood that this is intended to be generic to drops, streams and so on. Applicator 54 applied patterns 39 *a–e* and applicator 56 applied patterns 41 *a–e*. Note in FIGS. 1 and 4 that the direction of carpet movement is as indicated by arrow 43.

The machine 46, on the other hand is capable of dispensing drops (or streams) of liquid randomly over the entire tufted face of the carpet and is referred to as a TAK machine. A machine similar to machine 48 is illustrated in U.S. Pat. No. 3,964,860 and a machine similar to machine 46 is described in U.S. Pat. No. 4,010,709.

The carpet material is then conveyed downward into a tension compensating loop 58 and then upward to an elevation above the level of the carpeting 12 in the machines 46 and 48 to roller 60. The web of carpeting traverses around roller 60 beneath dye applicator 64. The latter, which is of conventional construction, is sometimes known as a Kusters applicator. Dye applicator 64 applies a continuous sheet or layer of dye to the tufted surface of the carpeting, over the entire width of the carpeting. In the application regions, the carpeting is horizontally oriented.

Figure 3:
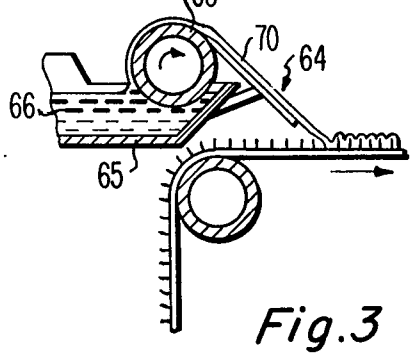
FIGS. 2 and 3 are side elevational view of portions of the apparatus of FIG. 1.

FIG. 3 illustrates a portion of the dye applicator 64. It includes a pan 65 for receiving dye 66 and a roller 68. The roller picks up a layer of the dye from reservoir 66 and this layer is brought into contact with the edge of doctor blade 70. The latter peels a sheet 72 of the dye away from the roller and delivers it to the tufted surface of the carpet. The gum applicator 42 includes a similar structure; however, a special set of input ports is employed to insure that the viscous gum will be of uniform height, as explained in my copending application Ser. No. 661,393.

The carpet enters the steamer 62 after it passes the applicator 64. The steamer includes a first set of rollers 74 for transporting the carpet in a first horizontal pass in the steamer, a second set of rollers 76 for transporting the carpet in a second horizontal pass in the steamer, this one with the tufts pointing downward, and a third set of rollers 78 for transporting the carpet in a third horizontal pass in the steamer.

The carpet exits the steamer in a substantially downward direction and passes into a washing apparatus 80. The latter has two compartments for washing the carpet and for removing unfixed dye, gum and chemicals from the carpet. The gum viscosity is lowered in the steamer 62 as a result of being heated and is readily removed in the washing apparatus. The remaining excess elements also are readily removed. The washed carpet passes into a suitable container 82 and is later transported to and dried in a drying machine (not shown).

In carrying out the process of the present invention, reservoir 16 in the pad machine 14 is filled with a prewet solution formed of water, surfactant, fabric softener and a defoamer having a pH of about 7. The sheet of relatively viscous colorless gum 72 (or other suitable liquid carrier) applied to the face of the carpeting preferable has a viscosity of about 1800 CPS but can lie within a range of about 600–5000 CPS. This sheet of gum may be about a quarter of an inch thick and is of uniform thickness when applied across the entire face of the carpet.

The gum applied to the carpet tends to sink into the spaces between the tufts and to coat varying portions of the tufts, as will be discussed in detail later. The depth to which the gum penetrates will vary at different parts of the carpet. In general, the viscosity of the gum is sufficiently high that it does not sink all of the way to the carpet backing although this may occur in isolated small regions.

In the present process, the machine 46 for applying drops of liquid is not in use and there is a relatively long distance between the applicator 42 and the first drop applicator 54. In one example this distance is about 12'7". The carpet traverses this distance in about 25 seconds. A gum viscosity of 1,800 CPS is found, in practice, to provide an average depth of gum penetration into the regions of carpeting containing upright tufts, of approximately 30 to 40 percent. This produces one kind of effect in the finished product. Lower gum viscosities permit deeper average gum penetration and higher gum viscosities shallower average penetration for different effects in the finished product for a given tufting density, lay of tufts, and time for penetration. The distance traveled affects the depth of gum penetration by affecting the time the gum is permitted to penetrate. The viscous gum may be made from any suitable vegetable base as described in the aforementioned copending application Ser. No. 651,396. The gum base is mixed with a defoamer, a preservative and acetic acid to provide a slightly acidic solution having a pH preferably in the range of 5.5–6.

The pH of any gum used in the process is significant. The higher the pH of the gum, the less the dye exhausts in the regions of the tufts coated with or saturated by the gum, that is, when the carpet reaches the steamer, very little of the acid dye will fix to the tufts covered or saturated by a substantially higher pH gum. For example, if the pH of gum 2 were very high, say 10.5, and this gum coated a tuft, a minimum amount of the acid dye (say of pH 3) would fix to this tuft. In practice, gum 2 may have a pH of 7, as an example, and this does have an effect in reducing the ability of a later applied dye to fix to a tuft coated with this gum.

The reservoir of drop applicator 54 contains a second water soluble gum, gum 2, mixed with acetic acid, a defoamer agent and water having a combined viscosity which is substantially lower than that of the gum applied by applicator 42. If the latter has a combined viscosity of 1,800 CPS, the combined viscosity of the gum applied by applicator 54 may be 600 CPS and its pH may be 7. This pH is higher than the dye pH and prevents some of the dye from fixing providing a shielding affect. This viscosity could be within the range of 600 to 1200 CPS and as already mentioned, will be lower than that of the sheet of gum so that it can pass readily through the sheet of gum.

There are number of factors which must be considered in choosing the viscosity of the gum 2. The viscosity must be sufficiently high that it masks those tufts or the portions of the tufts the gum 2 reaches from the lower viscosity later, Kusters applied dye (applied at 64). For a Kusters applied dye (dye 2) at a viscosity of about 30, the gum 2 should have viscosity of at least about 600 CPS to carry out this function. The higher the viscosity of gum 2, the greater its shielding effect, for a given dye 2 viscosity. The viscosity of gum 2 also should be sufficiently low so that the drops of gum 2 readily can penetrate into (and through) the sheet of gum 1 (applied at 42). For a gum 1 viscosity of 1800 CPS the gum 2 viscosity should not be higher than about 1200 CPS. If the gum 1 viscosity is greater than 1800 CPS, then the gum 2 viscosity can be greater than 1200 CPS; similarly, if the dye 2 viscosity is lower than 30 CPS, the gum 2 viscosity can be lower than 600 CPS. The lower the viscosity of gum 2, the quicker the penetration gum 2 through gum 1, for a given gum 1 viscosity, all other things being equal. Within the range specified, different viscosities chosen for gum 2 will cause different dyeing effects, generally in subtle ways.

The applicator 56 contains a first dye in a particular color. This dye may have a viscosity which is about the same as that of the gum in applicator 54, that is, a viscosity of about 600 CPS in this example. This viscosity also may have a value in the same range of 600 to 1200 CPS for reasons similar to the above given for the gum in applicator 54. Both gum 2 and dye 1 may have any viscosity value in these ranges.

The dye formulation is conventional. Dyes suitable for use with nylon carpeting are preferably water soluble acid dyes. In general, the dye may be formulated by mixing a number of different primary color dyes to form the desired color shade. The dye is selected to be compatible with the particular synthetic, natural or mixtures of fibres in the particular tufts being dyed.

Figure 4:
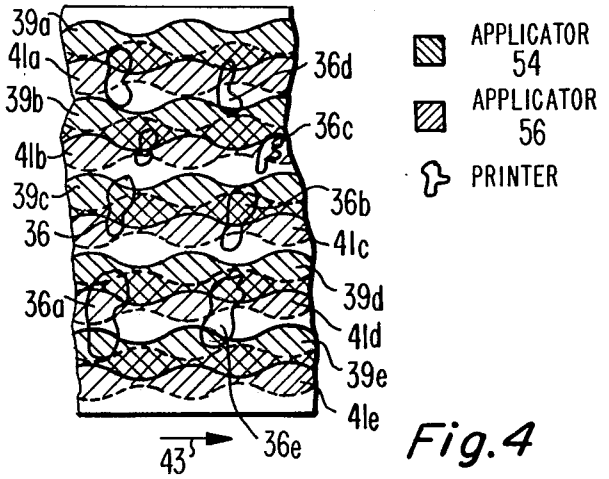
FIG. 4 illustrates some of the patterns produced by the apparatus of FIG. 1.

Applicators 54 and 56 dispense their respective liquids in drops and the drops are confined to the spaced areas 39*a–e* and 41*a–e*, respectvely, shown in FIG. 4. In the particular design illustrated, the gum drops produced by applicator 54, fall on regions 39*a–e* which are spaced from one another by intermediate regions which are not reached directly by the gum drops (although there may be some splashing. The dye drops produced by applicator 56 form a similar type of pattern in regions 41*a–e* which are spaced from one another. However, the patterns 39 and 41 produced by applicators 54 and 56, respectively, may or may not overlap entirely or partially. Some of the individual drops 94 dispensed by the applicator 54 may fall on some of the same tufts as the drops 97 dispensed by the applicator 56 and other of the respective drops will reach different tufts.

The reservoir of applicator 64 is filled with a second dye in another shade or color, call it color 2, which has a substantially lower viscosity than the color 1 dye. For example, if color 1 dye has a viscosity of 600 CPS the color 2 dye may have a viscosity of from 30–60 CPS, but could vary from this somewhat to achieve its desired effect, as will be explained.

While the dyes disclosed herein are water soluble acid dyes, for use on nylon yarns, should be understood that other yarn material, and also other types of dyes that are suitable for these other materials may be used instead.

Each of the dyes may be prepared and selected from available colors in the manner described in detail in the aforementioned copending application Ser. No. 851,418, filed Nov. 14, 1977. The pH of the two dyes used are acidic; they may have a pH of 3 or so, so that the dyes will fix relatively quickly in the steamer 62. This particular pH value is not critical and could vary but should remain within the acidic range. In one particular process, it is estimated that about 90–95 percent of the dyes become fixed during the first horizontal pass of the carpet within the steamer 62.

Figures 5, 6, 7, 8, 9, 10:
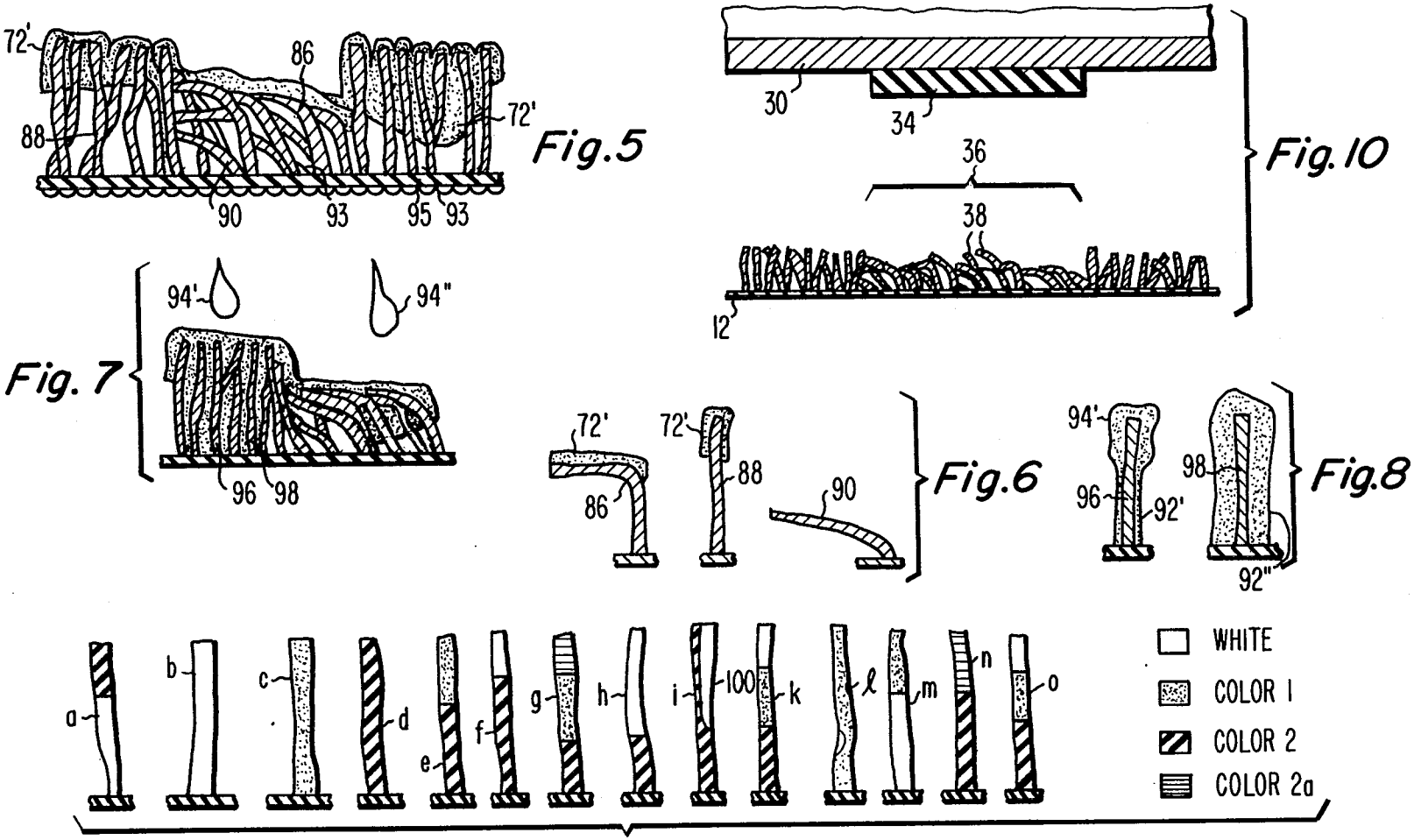
FIG. 5 is a fragmentary cross-sectional view taken through a carpet with a viscous liquid thereon.
FIG. 6 illustrates the condition of some of the yarn tufts after the viscous liquid is applied to the carpet face.
FIG. 7 illustrates a portion of carpet tufts receiving a viscous liquid first in sheet form and subsequently in droplet form.
FIG. 8 illustrates the condition of some of the yarn tufts upon receiving the first and second viscous liquid.
FIG. 9 is a side elevational view of some of the tufts illustrating several combinations of coloring that takes place in the process embodying the present invention.
FIG. 10 illustrates the operation of a portion of the apparatus of FIG. 1.

The various steps in the dyeing process are illustrated in FIGS. 5–8. FIG. 5 shows the gum 72 applied by the applicator 42 after the carpet has moved a distance from the point of application of the gum and before this section of the carpet has reached the applicator 54. The gum coating 72' penetrates into the carpet tufts to an average depth of 30–40 percent or so as discussed above. The penetration also depends on the volume of gum applied, the greater the volume the greater the penetration. However, in some areas, such as at 93, depending on the density of the tufts and the lay of the tufts, the penetration may be more, even to the backing 95. In the compressed areas 36 where the tufts are bent over, the density of the tufts is greater than in a non-compressed area and the film of viscous gum penetrates more slowly or cannot penetrate as deeply. Some of the various coating patterns (there are many others) are shown in FIG. 6. One tuft 86 is coated about half way on only one side by the gum coating 72'. Adjacent tufts, not shown, prevent the gum from reaching other surfaces of this tuft. Another tuft 88, which is not in the compressed area is coated only at its tip with gum 72'. A third tuft 90 which may be compressed underneath other tufts may not receive any gum at all. Other less numerous tufts may be fully coated with gum or with spots or flecks of gum. The viscosity of the gum layer and the time it has to penetrate the tufts are also factors in determining what part or parts of the various tufts become coated with gum.

FIG. 7 illustrates drops 94' and 94" of the second gum supplied by the applicator 54, falling on the gum-wetted carpet tufts. As a result of the force of gravity, these drops tend to penetrate the surface of the viscous gum layer and in some cases they pass through the viscous gum and reach the base of one or more tufts. The drops tend to penetrate more easily the regions of the carpet containing the more loosely-packed tufts than the regions which are compressed. FIG. 8 illustrates some of the different coatings which are produced. Tuft 96 is coated heavily with gum at the tip portion due to the viscous gum film coating 72' which is overlapped by the drop 94' of less viscous gum. Some of the gum 94' has run down the tuft and coated the bottom 60 percent or so of the tuft as shown at 92', so that the entire tuft 96 is coated with gum. Tuft 98 is a tuft over which a droplet 94' has formed an extra heavy coating 92'' of gum. Many other effects, too numerous to detail, also occur.

When the gum coated tufts described pass beneath the applicator 56, certain of these tufts receive spaced drops 97 of the relatively viscous color 1 dye. The tufts receiving only the viscous gum (applied by applicator 42) which receive also the color 1 dye have a relatively high affinity for the color 1 dye. This dye substantially immediately colors many of the regions of these tufts they reach. This dye passes through the gum layer and reaches the fiber, at least in part. Those tufts or portions thereof coated with the less viscous gum from applicator 54 have a relatively low affinity for the droplets of the color 1 since the less viscous gum occupies space in the tufts and also because gum 2 has a much higher pH than the color dye. The higher the pH of the gum, the slower acid dye fixes when the steamer is reached.

In those regions of the carpet which are compressed the penetration of the drops of gum is slowed down. Here, the drops of the color 1 dye tends to remain on the gum surface or in suspension in the gum and may not reach the fiber for some time. A drop of dye in the compressed area may "swim" on top until this area reaches the steamer. This drop may then color a previously uncolored tuft. This is rare. Most of the dye drops run into the gum, mingle with the gum, and spread around. The gum serves to attenuate or dilute the color as well as to spread the drops of dye.

When the carpet reaches applicator 64 it receives a film of low viscosity color 2 dye over its entire tufted surface. The part or parts of the tufts coated with gum or viscous dye have a relatively low affinity for any of this low-viscosity dye. The remainder of each tuft becomes colored by the color 2 dye. For example, if tuft 88 is in the condition illustrated in FIG. 6 when it reaches the applicator 64, the color 2 dye will color the unprotected bottom 60 percent of the tuft.

There is also some coloring which takes place in the steamer itself. For example, as mentioned previously, on the first horizontal pass through the steamer the low-viscosity color 2 dye becomes 90–95 percent or so fixed. On this pass, the viscosity of the gum is reduced because of heat. On the second horizontal pass, the remainder of the less viscous dye, if present on a tuft, may run down that tuft to the tip of the tuft. In those tufts which previously had their tips protected by viscous gum, some of the color 2 dye, attenuated in color, may now reach the tip of the tuft and become fixed there. In this example, the carpet traverses each pass somewhat more than one minute to achieve this affect. As another effect in the steamer, some of the viscous dye, sort of swimming in a viscous gum layer over a bent over tuft, which has already colored the tuft to some extent may color the tuft more strongly during the first horizontal pass in the steamer, in view of the reduced gum viscosity.

The pH of the bath in reservoir 16 affects what occurs in the steamer. If the pH is alkaline, it serves to slow down the fixation of the dyes in the steamer. This may allow them to wick down to the tuft tips more than desired (for purposes of creating a particular dyeing effect) during the second horizontal pass. In the present process the desired effect is obtained by making the pH of the bath in reservoir 16 neutral or somewhat acid. This helps neutralize the subsequently applied liquids to prevent fixing prior to the steamer. This also allows blending of some of the later applied colors as will be explained.

FIG. 9 illustrates some of the individual tufts as they appear in the final product. These are intended as examples only as there are many other combinations of coloring effects which occur. Tuft a in FIG. 9 is one which was compressed such that the tip did not receive any gum. However, the lower 70 percent of the tuft received the first and second gums hereinafter termed gums 1 and 2, respectively. No droplets of color 1 fell on this tuft. When this tuft passed through the applicator 64 only the tip portion was colored with color 2, the rest of the tuft was protected from color 2.

Tuft b was coated in its entirety by both gums. This tuft did not receive color 1, and was not receptive to color 2.

Tuft c was coated with gum 1 but not gum 2. This tuft also received the color 1 dye. Color 1 ran down the entire tuft and colored it.

Tuft d did not receive gum 1 or gum 2 or the color 1 dye. This tuft had maximum affinity for the color 2 dye and was dyed in its entirety by this dye.

The upper 30 percent of tuft e, was coated with gum 1 and its lower 70 percent did not receive any gum. A color 1 dye droplet landed on the tip of tuft 3 and dyed it, and the color 2 dye colored the lower 70 percent of the tuft.

Tuft f received gum 1 at its upper 25 percent and no gum 2 or color 1 on the lower 75 percent. The lower 75 percent is colored with color 2. The tip is uncolored, possibly because there was a very heavy gum layer still protecting the tips on the second pass of the carpet in the steamer or possibly because all or almost all of the color 2 dye became fixed during the first horizontal pass. It is also possible that a low pile area pools some of the gum forming a gum reservoir. If a tuft such as the tip of tuft f sits in this reservoir, the tip will be uncolored.

Tuft g is a tuft that was compressed, which received gum 1 at its tip, gum 2 at the upper 20 percent of its tip, and color 1 dye at its upper 60 percent. Color 1 dyed only the upper 60 to 20 percent region. Color 2 dyed the lower 40 percent near the base of this tuft. The top 20 percent of this tuft is dyed in dye color **2*a*, which is attenuated color 2** dye that ran to this region during the second pass through the steamer.

Tuft h received gum 1 and possibly gum 2 but not color 1. This tuft is dyed in color 2 near its base.

Tuft i was a tuft that was in the compressed area 36. The side surface 100 of the tuft was covered by gum 1 facing upwardly as illustrated in FIG. 5. This tuft is similar to tuft 86 (FIG. 6). The side of the tuft opposite the surface 100 received no gum and no color 1. This opposite side and the base are dyed in color 2 while the surface 100 remains without color.

Tuft k received gum 1 and 2 at its upper end. This tuft also received color 1 at its upper end. Color 1 only colored that portion of the upper end coated by gum 1 and was relatively unabsorbed by the tip coated with the gum 1 and gum 2. The base of the tuft did not receive any of the color 1 and was colored by color 2.

Tuft L received gum 1 at its upper end and received also color 1 which ran down and coated only part of the surface of this tuft. Small droplets of gum 2 splattered onto this tuft in small areas. These appear as small scattered white spaces surrounded by color 1.

Tuft m received gum 1 which penetrated the full tuft length and gum 2 which coated only the lower 50 percent of the tuft, the upper end being compressed and protected from gum 2. This tuft received color 1 only at the upper end, and that end is colored by color 1.

Tuft n was coated with gum 1 at the upper end and did not receive color 1 or gum 2. This tuft is colored with color 2*a* at the upper end and color 2 at the lower end. Many tufts are like this one.

The upper 30 percent of tuft p was coated with gum 1. The mid 30 percent received color 1. Color 2 colored only the bottom 30 percent.

The different color effects shown in FIG. 9 are found to be present in the finished product. There are also many other combinations of colors which are present. The theory given to explain why the individual tufts assume the multiple colors and shades shown is believed to be accurate; however, whether or not this is so, the overall multi-color effect achieved in the finished carpet is very pleasing to the eye and is obtained in an economical way using only a relatively few colors. It is to be understood that while the process illustrated employs only two dye colors, it is possible to employ more or fewer than two colors. As one example, the drop applicators may apply drops of viscous dye in say two or three colors, and the applicator 64 may apply less viscous dye in yet another color. In any case, many individual tufts have varied shadings and colors, with one color (often chosen to be a darker shade) at the base of the yarns for some tufts, a whiteish overall effect for other tufts and variations of colors 1 and 2 blended throughout as well as diluted colors present on the tips of some of the tufts.

Pressing of some of the tufts by the press roller 20 permits some tufts to be completely protected from any of the gums and drop applied dyes, permitting them to become colored completely by the film applied dye. These completely protected tufts are relatively few in number and in cases in which color 2 is a dark shade, these completely protected tufts become dyed in their entirety in color 2 (see tuft d, FIG. 9.), providing the pleasing contrast of isolated darkly shaded areas in an overall more lightly colored carpet. The completely undyed tufts (b in FIG. 9) which are relatively few in number, also provide an interesting contrasting effect with most of the tufts which are in multiple colors and shades.

While particular droplet applicators have been described, the manner of applying gum 2 and color 1 may vary from that shown as long as these are applied in spaced regions of the carpet, rather than to all of the tufts. Since the gums and high viscosity dye act as a shield to the low viscosity color 2 dye, there is no registration problem for the color 2 dye and it may be applied right over the gums and the color 1 dye, in the manner shown.

The following are specific examples of processes embodying the present invention:

EXAMPLE 1

The textile is a 12 or 15 foot wide carpet comprising backing material tufted with nylon yarn. This carpet first is treated with the following pre-wet solution in the pre-wet bath.

| | |
|---|---|
| 0.34 kg | acetic acid |
| 6.8 kg | "Pomoco JW" a tradename of Piedmont Chemical Industries, Inc., North Carolina which is a long chain fatty alcohol amide with anionic surfactant |
| 11.34 kg | "Chemcoloft 75-N" a tradename of a Chemical Processing of Georgia Company which is a fabric softener formed of a fatty imidazoline polyethylene emulsion |
| 1 kg | "Quadafoam MA" which is a tradename for Quaker Chemical Corporation, North Carolina which is a modified silicone base formed of silicone and chlorinated parafin used as a defoamer |
| 6.25 kg | Syngum D47D |

The above ingredients are dissolved in sufficient water at room temperature to produce a 5,000 lb. mixture having a pH of 7. In more detail, the mixture is preferably prepared as follows. A premeasured tank is filled about half-way with tap water heated to room temperature. The gum is added and then mixed. The remaining chemicals are then added to a predetermined level to produce the desired 5000 lb mixture. This mixture is then mixed for about 2 hours. Similar procedures are followed for the pre-wet, gum, and dye mixtures described below. In all cases, where acids are used, they should be the last ingredients added. This solution is placed in the pad machine 14. The carpet is run at 30 feet per minute through the pre-wet solution in the pad applicator with 30 lbs. per square inch of roller pressure on the pre-wet solution. The carpet is then back beated and then press rolled in a selected pattern to compress the tufts in that pattern.

| Gum 1, Gum Applicator 42 | |
|---|---|
| 4.54 kg | Syngum D47D manufactured by the Stein Hall Company or General Mills |
| 0.454 kg | Quadafoam MA |
| 0.454 kg | DXN a preservative, Dimethoxano |
| 0.068 kg | Acetic Acid |

The above ingredients are dissolved in suffficient tap water at room temperature to obtain a liquid mixture have a viscosity of 1,800 CPS and a pH of 5.5–6.

| Gum 2, Applicator 54 | |
|---|---|
| 0.4 kg | Quadafoam MA |
| 5.6 kg | Syngum D47D |
| 0.14 kg | Acetic Acid |

The above ingredients are mixed with tap water at room temperature to make a 2000 lb. mixture having a pH of 7 and a viscosity of 600 CPS.

| Color 1, Applicator 56 | |
|---|---|
| 2.72 kg | Progowet FS - a tradename of the Chemical Process of Georgia Company which is an Ethoxylated Alephatic alcohol |
| 2.72 kg | Formic Acid |
| 5.6 kg | Syngum D47D |
| 0.4 kg | Quadafoam MA |
| 0.4 kg | H-100 - a tradename of WACO Chemical Company of Dalton, which is a chelating agent or water softener, comprising Ethylene Diamine Tetra Acetic |

-continued

| Color 1, Applicator 56 | |
|---|---|
| | Acid (EDTA) |
| .270 kg | Acid Yellow 24 |
| .090 kg | Acid Red 337 |
| .078 kg | Acid Blue 277 |

The above ingredients are mixed with tap water at room temperature to make a 2000 lb. mixture. The mixture has a pH of 3 and a viscosity of 600 CPS.

| Color 2, Applicator 64 | |
|---|---|
| 8.16 kg | Formic Acid |
| 6 kg | Syngym D47D |
| 1.2 kg | Quadafoam MA |
| 1.2 kg | H-100 |
| 16.2 kg | Acid Yellow 219 |
| 5.4 kg | Acid Red 337 |
| 10.8 kg | Acid Blue 277 |

The above ingredients are mixed with tap water at room temperature to make a 6000 lb. mixture having a pH of 3 and a viscosity of 30 CPS. This mixture is applied to the entire carpet as a film.

EXAMPLE 2

The material is the same as in example 1. The pre-wet mixture is the same as in example 1, at 140 percent pick-up.

Gum 1, Applicator 42

The gum mixture is the same as in example 1 except that the pH is 6.5. The higher acidity is obtained by using more acetic acid.

| Color 1, Applicator 56 | |
|---|---|
| .026 kg | Acid Yellow 219 |
| .015 kg | Acid Red 337 |
| .300 kg | Acid Blue 277 |

The remaining chemicals are the same as in example 1.

The above ingredients are mixed with tap water at room temperature to make a 2000 lb. mixture having a viscosity of 600 CPS and a pH of 3.

| Color 2, Applicator 64 | |
|---|---|
| 9.000 kg | Acid Yellow 219 |
| 2.160 kg | Acid Red 337 |
| 8.640 kg | Acid Blue 277 |

The remaining ingredients are the same as in example 1.

The above ingredients are mixed with tap water at room temperature to make a 6000 lb. mixture having a viscosity of 30 CPS and a pH of 3.

Nylon carpeting produced in accordance with the two examples above contained multi-color hues in which the dyes colored by applicators 56 and 64 were separately visible on the finished carpet. Additional variations of shadings were observed from white to light colors exhibiting variations in the depth of color applied by applicator 64. The overall impression was that of a pleasing multi-hued effect.

It is to be understood that particular compositions or numbers of dyes used in the three examples above are not critical to the invention. While the dyes formulated in the examples above were made with a water base, it would be equally apparent that dyes with other bases having a different viscosity could also yield similar effects. In all of the above examples, the pH may be set to the desired value by adjusting the amount of acid added to amounts different than in the examples due to variations in pH in the water and the other elements added.

What is claimed is:

1. A nylon tufted textile material dyeing process:

applying a sheet of a first colorless aqueous gum solution at a first viscosity in the range of 600–5000 CPS over the entire surface of the textile material, said gum solution being miscible with and chemically inert with first and second aqueous acid dye solutions, applying a second colorless aqueous gum solution at a second viscosity of about $\frac{1}{3}$ to $\frac{2}{3}$ the viscosity of the first solution to a first portion of said surface coated with said applied sheet, said second solution being miscible with and chemically inert with said first solution and said first and second dye solutions, applying said first acid dye solution at a third viscosity of about $\frac{1}{3}$ to $\frac{2}{3}$ the viscosity of the first gum solution to a second portion of said coated surface, applying said second acid dye solution at a fourth viscosity of about 1/10 or less the third viscosity to a third portion of the coated surface greater in area than and including said first and second portions, and fixing the dyes of said first and second dye solutions to said textile material.

2. The process of claim 1 wherein said fourth viscosity is at most about 10 percent of the viscosity of said second and third viscosities, and at most about 5 percent of the viscosity of said first viscosity.

3. The process of claim 1 wherein said first viscosity is at least about 1000 CPS, said second and third viscosities are at least 500 CPS, and said fourth viscosity is in the range of about 30–60 CPS.

4. The process of claim 1 further including the steps of prewetting the textile material, back beating the textile material to stand the tufts upright, and pressing a fourth portion of the textile material to lay the tufts down in said fourth portion, all of the above occurring prior to the steps of claim 1.

5. A tufted nylon textile material dyeing process comprising:

wetting the textile material with an aqueous pre-wet solution, squeezing a portion of the pre-wet solution from the textile material, applying a layer of a water soluble gum solution to the face of the textile material, said layer having a first viscosity in the range of 600–5000 CPS, transporting the coated wet textile material, applying drops of an aqueous colorless gum solution to the coated, wet face of the textile material during said transporting, said gum solution drops having a second viscosity of about $\frac{1}{3}$ to $\frac{2}{3}$ the first viscosity, applying drops of water soluble aqueous acid dye solution to the coated wet face of the textile material during said transporting, said latter dye solution having a third viscosity of about $\frac{1}{3}$ to $\frac{2}{3}$ the first viscosity, applying a layer of an aqueous acid dye solution over said face during said transporting, said layer of dye solution having a fourth viscosity of about 1/10 or less than said second and third viscosities and fixing the dyes of said solutions to said textile material.

6. The process of claim 5 wherein said fixing step includes transporting said textile material with said face up and then down.

7. The process of claim 5 wherein the ratio of said first viscosity to said second and third viscosities is about 3:1 and the ratio of said first viscosity to said fourth viscosity is about 60:1.

8. The process of claim 5 further including the steps of a back-beating the tufted material to stand the tufts up and then pressing a portion of the face of the textile material to lay down the tufts in said portion prior to applying said layer of gum solution.

* * * * *